United States Patent [19]

Bailey

[11] Patent Number: 5,065,574

[45] Date of Patent: Nov. 19, 1991

[54] PARTICULATE TRAP REGENERATION APPARATUS AND METHOD

[75] Inventor: John M. Bailey, Dunlap, Ill.

[73] Assignee: Caterpillar Inc., Peoria, Ill.

[21] Appl. No.: 531,264

[22] Filed: May 29, 1990

[51] Int. Cl.[5] ..... F01N 3/02

[52] U.S. Cl. ..... 60/274; 55/283; 55/294; 55/466; 55/DIG. 30; 60/295; 60/303; 60/311

[58] Field of Search ..... 60/274, 295, 303, 311, 60/296; 55/283, 294, 302, 466, 484, DIG. 30

[56] References Cited

U.S. PATENT DOCUMENTS

| | | | |
|---|---|---|---|
| 4,054,417 | 10/1977 | Rosebrock . | |
| 4,276,071 | 6/1981 | Outland | 55/523 |
| 4,293,357 | 10/1981 | Higuchi et al. | 156/89 |
| 4,329,162 | 5/1982 | Pitcher, Jr. | 55/523 |
| 4,343,631 | 8/1982 | Ciliberti | 55/302 |
| 4,359,864 | 11/1982 | Bailey | 60/311 |
| 4,478,618 | 10/1984 | Bly et al. | 55/314 |
| 4,481,767 | 11/1984 | Stark | 60/303 |
| 4,549,399 | 10/1985 | Usui et al. | 60/286 |
| 4,573,317 | 3/1986 | Ludecke | 60/303 |
| 4,600,415 | 7/1986 | Barton | 55/294 |
| 4,641,496 | 2/1987 | Wade | 60/274 |
| 4,833,883 | 5/1989 | Oda et al. | 60/311 |
| 4,875,335 | 10/1989 | Arai | 60/274 |
| 4,875,336 | 10/1989 | Hayashi et al. | 60/286 |
| 4,916,897 | 4/1990 | Hayashi | 60/296 |

FOREIGN PATENT DOCUMENTS

| | | | |
|---|---|---|---|
| 223215 | 10/1986 | Japan | 60/296 |
| 2218008A | 11/1989 | United Kingdom . | |

OTHER PUBLICATIONS

SAE paper No. 900603 by K. Hayashi et al. presented at the SAE International Congress and Exposition in Detroit, Michigan, during the period of Feb. 26–Mar. 2, 1990.

*Primary Examiner*—Douglas Hart

*Attorney, Agent, or Firm*—Charles E. Lanchantin, Jr.; J. Wesley Blumenshine

[57] ABSTRACT

Prior art trap regeneration devices employ one or two relatively large ceramic trap cores, and a regeneration cycle that burns off the soot in a direction that subjects the porous walls to excessive temperature spikes. Moreover, during regeneration it is normal to bypass dirty exhaust gas directly to the atmosphere. In a first embodiment the subject trap regeneration apparatus includes an electrical heating element and a reverse flow device for each of a plurality of relatively smaller trap cores arranged in a housing, with each reverse flow device constructed for directing a source of air at a controlled rate toward the normal second end of the trap core, heating the air, forcing the heated air through the trap core to the first end, and to controllably burn out particulate matter while the remaining trap cores are functioning to filter the exhaust gases in the normal flow direction. In a second embodiment a heater and reverse flow device is movably positioned before a selected one of the smaller trap cores and a reverse flow burnout method employed similar to the first embodiment. Preferably, the reverse flow device includes a choking orifice for controlling the rate of flow of the air to the selected trap core.

42 Claims, 7 Drawing Sheets

16
60
20
32
58
24
44
34
30
10
56
36
28
2
40
104
38
46
18
22
218
28
2
12
40
100
216
46
214
28
30
224
212
220
40
222
26
54
194
192
180
14
210
196
132
198

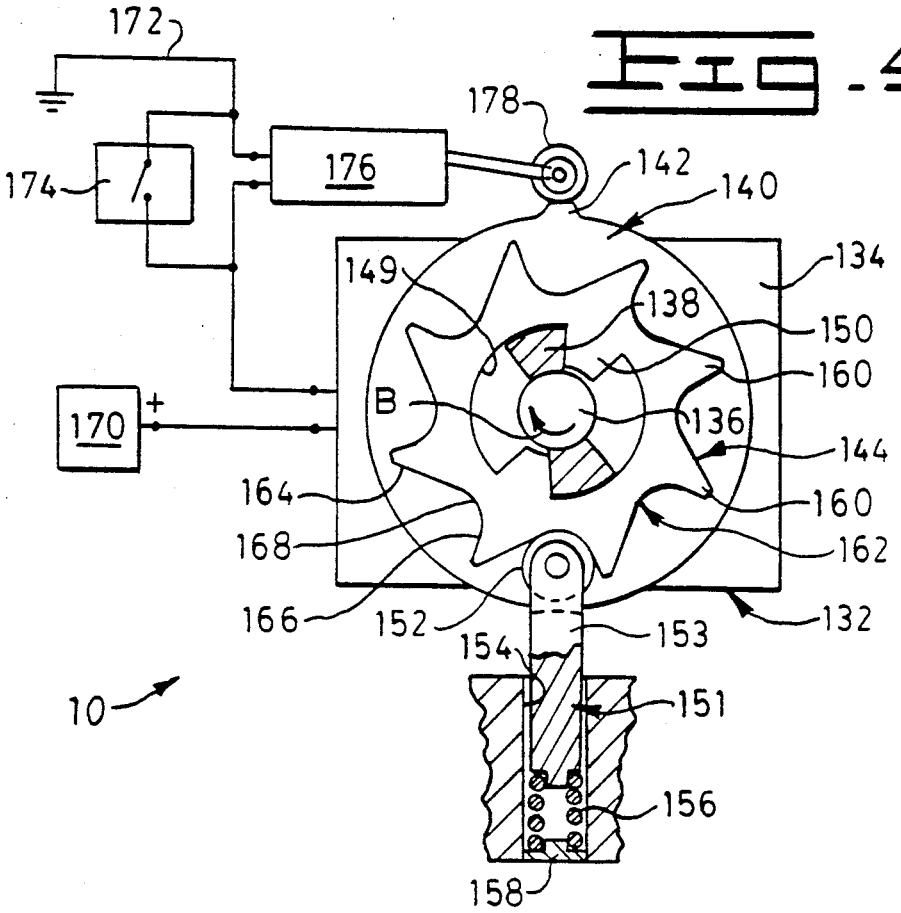
Fig. 4.
Fig. 5.
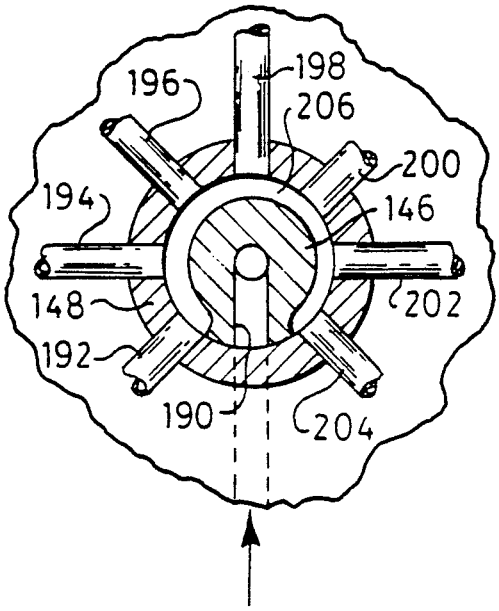

PARTICULATE TRAP REGENERATION APPARATUS AND METHOD

DESCRIPTION

1. Technical Field

This invention relates to an apparatus for regenerating a particulate trap for a diesel engine or the like, and more particularly to an apparatus and method for periodically cleaning a generally ceramic trap by controlled burn-out of the particulate matter accumulated therein.

2. Background Art

An intensive effort is underway by the engine industry to develop a method of trapping diesel exhaust particulates that will meet the Environmental Protection Agency (EPA) emission regulations targeted for 1991 and 1994. Many companies believe that the more stringent regulations of 1994 cannot be met without the use of a particulate trap.

The particulate traps produced by Corning Incorporated, of Corning, N.Y. are generally representative of a leading design to meet the 1994 requirements. Each trap is usually a cylindrical monolithic ceramic structure having thin porous walls and a plurality of elongate passages parallel to the central axis thereof. The opposite ends of the adjacent passages are plugged to force the exhaust gas to flow through the porous walls which results in the filtration of the gas and the removal of the soot at efficiency levels above 85%. The particulate traps shown in U.S. Pat. Nos. 4,276,071 issued June 30, 1981 to R. J. Outland; 4,293,357 issued Oct. 6, 1981 to N. Higuchi, et al.; and 4,329,162 issued May 11, 1982 to W. H. Pitcher, Jr. are illustrative of these so-called porous wall flow type traps.

However, these traps quickly fill up with particulate material and cause an undesirable back pressure on the engine. So far, the regeneration or cleaning of the traps has been such a difficult problem that each proposed solution has obvious drawbacks. For example, efforts to burn the soot have resulted in failure of the ceramic cores by melt-down or by thermal stress. The overtemperature conditions which lead to these failures are the result of the energy and temperature produced by the burning soot during regeneration. In an attempt to prevent these failures, complicated control systems, exhaust by-pass arrangements and the like have been designed and evaluated. But these systems have proven to be expensive and not sufficiently reliable to prevent the damage of the traps due to the complexity of the controls, the variability of the exhaust conditions, the time period between regenerations, etc. In addition, unacceptable penalties are imposed on the operation of the engine, the existing trap concepts are subject to eventual plugging by ash which is not removed during the regeneration process, and exhaust gas with particulate material therein is typically by-passed directly to the atmosphere during the regeneration period.

In a typical prior art system, the exhaust gases enter the trap through a first plurality of passages that open solely on the inlet ducting, flow through the porous ceramic walls, and exit via a second plurality of passages that open solely on an outlet duct. In the traditional method of regeneration the engine exhaust is heated and/or a combination of exhaust and supplementary air are heated by an electrical heating grid or by a attachment burner unit located before the trap. The retained soot is eventually ignited adjacent at the inlet end of the trap and the hot burning zone passes across the trap toward the outlet end thereof. During such regeneration at least a substantial portion of the normal exhaust of the engine is by-passed to the atmosphere in the unfiltered state if only one trap is used, or if two traps are used one is used in the normal mode while the other one is being regenerated. In either event the hot products of combustion of the soot are forced directly into the porous material, thus heating the material to such a high temperature that the service life of the trap is adversely affected. Attempts to reduce the probability of failure of the trap have included minimizing the supply of the oxygen-containing gas after the soot has ignited, increasing the supply of supplementary oxygen-containing gas substantially to cool the trap, and using catalysts to reduce the temperature at which the soot ignites. These approaches complicate the apparatus and/or controls and can even cause the formation of undesirable sulfates and/or ash.

Accordingly, what is needed is a reasonably simple, reliable and long-lived apparatus and method for regenerating a trap of the character described by burning out the particulate material regardless of the degree of soot or particulate loading in the trap or the operating conditions which exist in the engine at the time regeneration is required. Furthermore, the apparatus and method should prevent the by-passing of relatively dirty exhaust gas during regeneration. Finally, it should greatly reduce or essentially eliminate the long term plugging of the trap by noncombustible ash and similar material.

DISCLOSURE OF THE INVENTION

In accordance with one aspect of the invention, a particulate trap regeneration apparatus is provided for a particulate trap core having a first end opening on a duct containing exhaust gases having particulate matter therein, and allowing the egress of filtered exhaust gases from a second end thereof to another duct. Particularly, regeneration means are provided for directing a source of an oxygen-containing gas toward the second end of the trap core, heating the oxygen-containing gas, forcing the heated oxygen-containing gas to travel through the trap core and egress at the first end thereof, and controllably burning the particulate matter accumulated within the trap core (61) in a reverse flow manner.

In another aspect of the present invention, a method includes normally exposing a first end of a trap core of the porous wall flow type to a duct containing a source of exhaust gas from an engine having particulate matter therein, and allowing the egress of filtered exhaust gas to another duct at a second end of the trap core, and when the trap has accumulated soot or the like regenerating the dirty trap core using the steps of: (a) directing a source of an oxygen-containing gas at a controlled rate toward the second end of the trap core through a reverse flow device coaxially aligned therewith; (b) heating the oxygen-containing gas; (c) forcing the heated oxygen-containing gas to travel through the trap core and egress at the first end thereof; and (d) controllably burning the particulate matter contained in the trap core.

In another aspect of the present invention, a particulate trap regeneration apparatus includes an inlet duct exposed to exhaust gases, an outlet duct, and a particulate trap core having first and second ends in respective communication with the inlet and outlet ducts. The trap core is of the porous wall type, and regeneration means is provided for heating a source of pressurized air and forcing the heated air at a controlled rate into the second end of the trap core, through the porous walls, and into the inlet duct in a reverse flow direction and burning a substantial portion of the particulate matter accumulated on the porous walls.

In a further aspect of the present invention a particulate trap regeneration apparatus includes an exhaust housing having a first partition defining a first plurality of openings, a second partition defining a second plurality of openings, first means defining an inlet duct outboard of the first partition, and second means defining an outlet duct outboard of the second partition. A sleeve is sealingly connected between the partitions between each pair of the respective first and second openings, and a particulate trap core is contained within each sleeve and has a first end opening on the inlet duct and a second end opening on the outlet duct. The regeneration apparatus advantageously includes a reverse flow device coaxially associated with each trap core, and means for operating a selected one of the reverse flow devices, directing a source of an oxygen-containing gas toward the second end of the selected trap core, heating that gas, forcing the heated gas through the selected trap core to egress at the first end thereof, and controllably burning the particulate matter accumulated within the selected trap core, while simultaneously allowing the remaining trap cores to filter the exhaust gases in a normal manner.

In a still further aspect of the invention a particulate trap regeneration apparatus includes an exhaust housing having a first partition defining a first plurality of openings, a second partition defining a second plurality of openings, first means defining an inlet duct outboard of the first partition, and second means defining an outlet duct outboard of the second partition. A sleeve is sealingly connected between the partitions between each pair of the respective first and second openings, and a particulate trap core is contained within each sleeve and has a first end opening on the inlet duct and a second end opening on the outlet duct. For regeneration of the trap cores a conical housing with a heating element connected thereto is provided along with means for positioning the conical housing and heating element into coaxial alignment with a selected one of the trap cores, and thereafter directing a source of an oxygen-containing gas toward the second end thereof, heating that gas and directing it through the selected trap core and out the first end thereof, and burning out the particulate matter accumulated therein, while simultaneously filtering the exhaust gases in the remaining trap cores.

The trap regeneration apparatus of the present invention is expected to have a particle removal efficiency rate of more than 85% without any bypassing of unfiltered exhaust gases to the atmosphere as is commonly done with prior art devices. Moreover, a plurality of smaller trap cores are used with the trap cores being subjected to substantially lower temperature gradients during regeneration because heated air is controllably directed therethrough in a reverse flow direction to the flow direction of prior art regeneration devices and substantially independent of variations of the exhaust gases.

BRIEF DESCRIPTION OF THE DRAWINGS

FIG. 4 is a diagrammatic cross sectional view of the control device shown in FIG. 3 as taken along line 4—4 thereof;

FIG. 5 is a diagrammatic cross sectional view of the control device shown in FIG. 3 as taken along line 5—5 thereof;

BEST MODE FOR CARRYING OUT THE INVENTION

Figure 1:
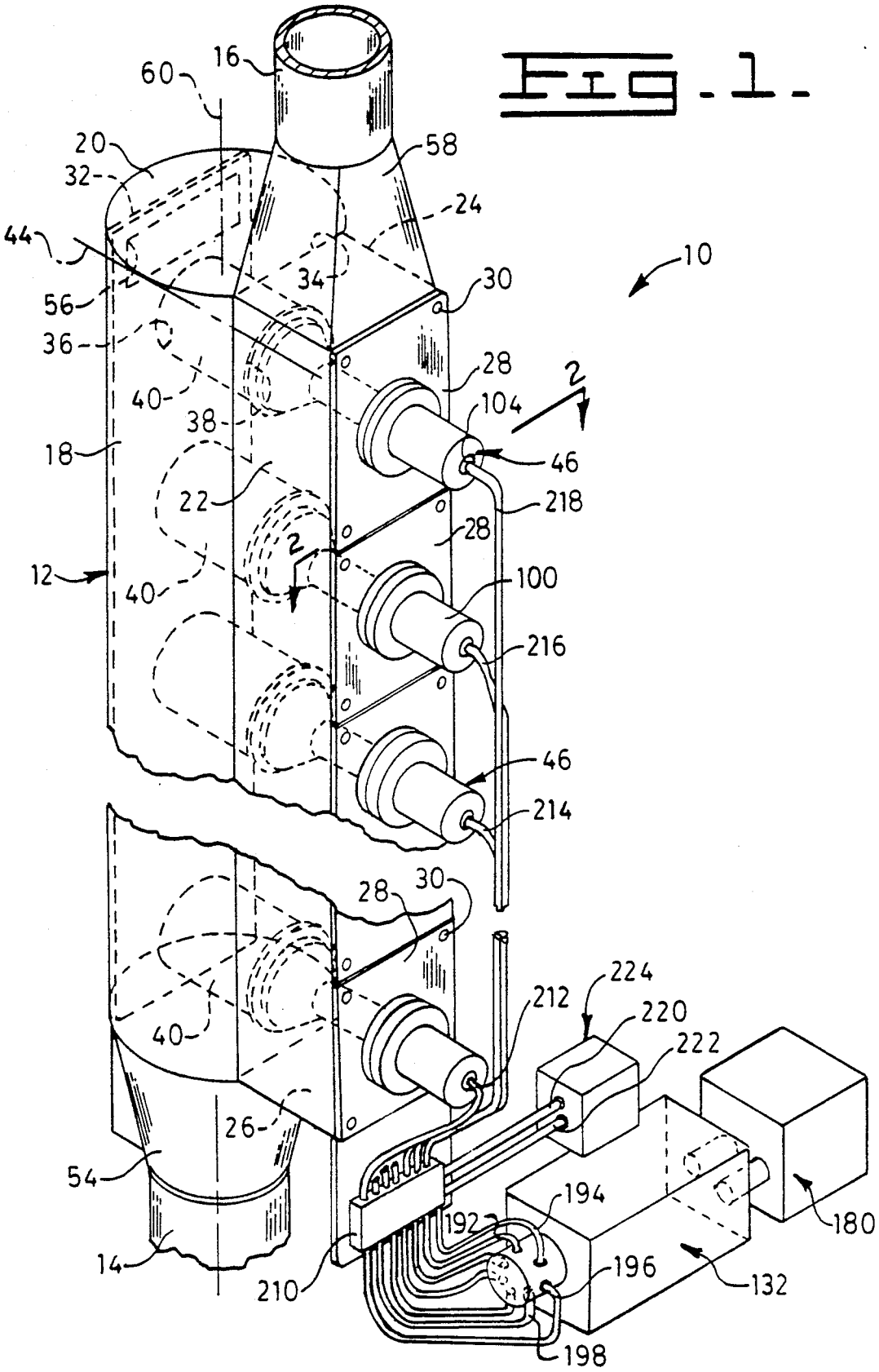
FIG. 1 is a diagrammatic pictorial elevational view of a particulate trap regeneration apparatus constructed in accordance with the present invention, with a repetitive central portion of the vertical stack broken away for illustrative convenience.

As is diagrammatically illustrated in FIG. 1, a particulate trap regeneration apparatus 10 is shown as it might be installed on a heavy duty, on-highway hauling truck in the location of the usual muffler. It is contemplated, however, that the regenerator apparatus 10 could be serially connected to a conventional muffler, although it inherently has noise-muffling capability. The apparatus 10 includes a vertically arranged exhaust housing or stack 12 connected at the bottom to an engine exhaust inlet pipe 14 and at the top to an outlet pipe 16. The housing includes a slotted tubular wall 18 having a generally C-shaped cross section and a top cap 20, upstanding parallel walls 22 and 24 preferably integrally extending from the slotted wall 18 and having a floor 26, and a plurality of removable covers 28 releasably secured to the walls 22 and 24 by a plurality of fasteners or bolts 30.

Figure 2:
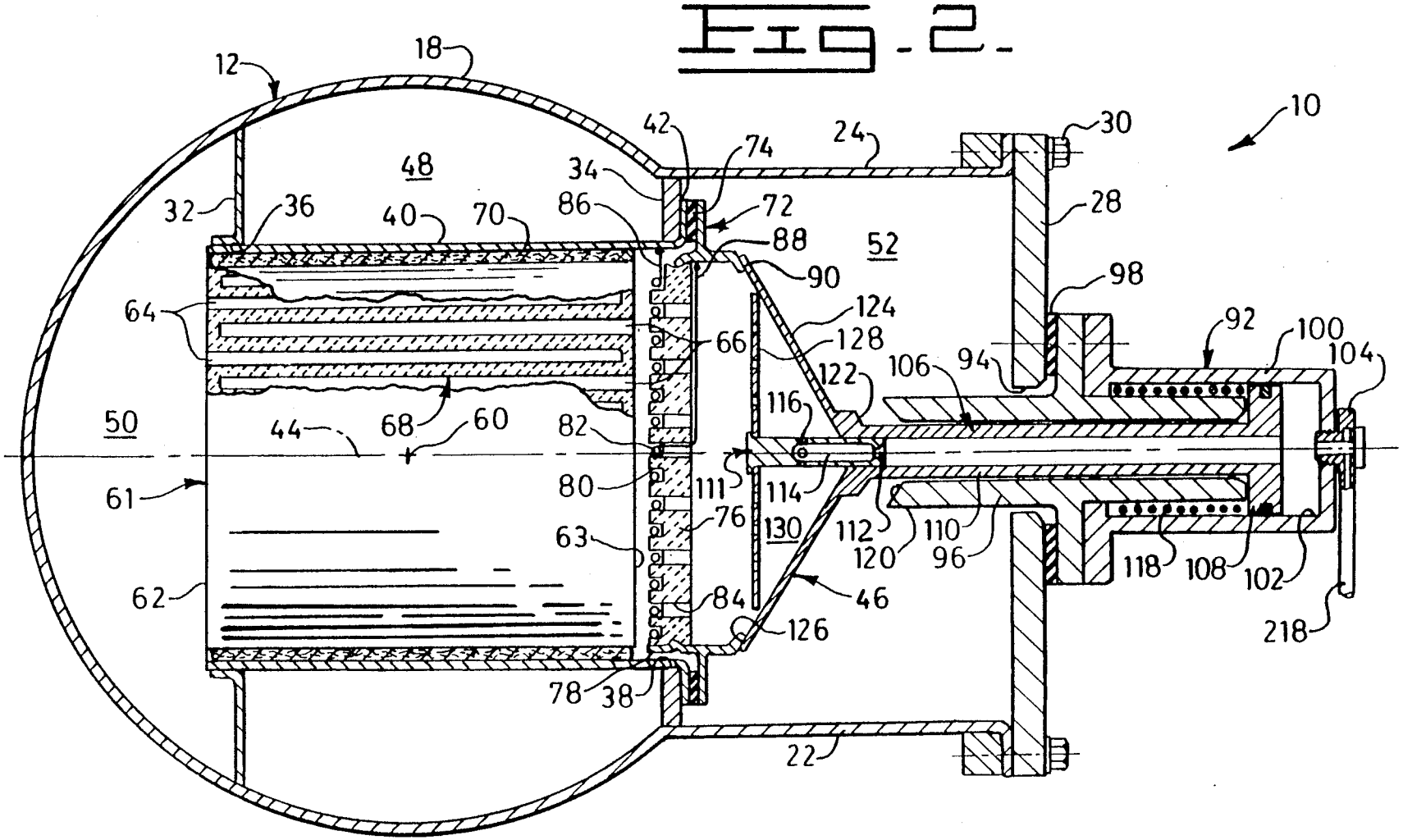
FIG. 2 is a horizontal cross section of a representative trap assembly as taken along line 2—2 in FIG. 1.

As is shown also in FIG. 2, the exhaust housing 12 has first and second internal planar partitions 32 and 34 that are essentially parallel to each other and parallel to the covers 28, and that individually have a plurality of uniformly vertically spaced apart circular openings 36 and 38 therethrough respectively. A cylindrical sleeve 40 having an annular flange 42 at one end and a central axis 44 extends in a horizontal manner to be tightly and sealingly received between each corresponding pair of these openings. In the particulate trap regeneration apparatus 10, illustrated in FIGS. 1-5, seven similar trap assemblies 46 are utilized, although only four are shown in FIG. 1. The maximum number of trap assemblies used will depend primarily on the time required for them to become loaded with particulate matter, the time required to regenerate each one, and size constraints. However, at least two trap assemblies 46 are preferred to allow one to be operating normally while the other is operated in a regenerating mode.

Each trap assembly 46 is at least in part mounted on one of the releasable covers 28 coaxially with the vertically spaced apart sleeves 40. Thus, a flow passage 48 is defined centrally between the first and second partition walls 32 and 34 and within the slotted wall 18 about the sleeves 40, another duct or flow passage 50 is defined between the slotted tubular wall 18 and the first partition 32 at one outboard side of the partition walls, and a further duct or flow passage 52 is defined between the second partition 34, the walls 22 and 24, and the covers 28 at the opposite outboard side of the partition walls. As can be appreciated by reference to FIG. 1, the inlet pipe 14 is in open communication with the centrally disposed duct 48 through a diverging transition tube 54 such that exhaust gases can travel upwardly about the sleeves 40. An opening 56 is defined in the upper portion of the first partition 32 to allow such gases to thereafter pass into the duct 50 and to travel downwardly to communicate with the individual trap assemblies 46. After passing through the trap assemblies the filtered exhaust gases travel upwardly in the remaining duct 52 to a converging transition tube 58 connected to the outlet pipe 16.

A cross section of a representative one of the trap assemblies 46 is illustrated in FIG. 2, with the plane of the cross section being perpendicular to a vertical central axis 60 of the slotted tubular wall 18. Each trap assembly includes a cylindrical particulate trap core 61 made of a high temperature resistant ceramic material and having a first end 62 for normally receiving the exhaust gases and a second end 63 for discharging the filtered exhaust gases. Preferably, the trap core defines a first plurality of passages 64 in open communication with the interior of the duct 50, and a second plurality of passages 66 in generally open communication with the interior of the duct 52 during normal operation. The elongate and juxtaposed passages 64 and 66 are exaggerated in size within the broken open sectionalized window in FIG. 2 in order to view them. In the diagrammatic and enlarged view of the preferred trap core 61 illustrated in FIG. 6, it can be better appreciated that the opposite ends of adjacent passages are blocked or plugged in order to force the exhaust gases to travel radially through a plurality of relatively thin porous walls identified by the reference number 68. Porous walls 68 are typically in the range of 0.5 millimeters thick, or less. Since these wall flow trap cores are known in the art, they need not be further described.

Each of the trap cores 61 is sealingly secured within the respective sleeve 40 by a cylindrical band or mat 70 of an insulating material having resistance to high temperature. The sleeve flange 42 is releasably secured to the second partition 34 at the opening 38, and an annular retainer 72 is connected to the flange through an electrically insulating washer pad 74 by any suitable electrically insulated fastening device, not shown. Each trap assembly 46 includes a ceramic disc 76 which is secured radially within an inboard annular collar 78 of the retainer 72, and which has formed therein one or more spiral grooves 80 that open inwardly toward the trap core 61 to receive a corresponding number of electrical heating elements 82, only one of which is shown. A plurality of holes 84 extend through the disc 76 at preselected relatively uniform distances along the spiral grooves 80, and one end of each heating element 82 is electrically connected to the grounded sleeve 40 as at 86, and the other end is electrically connected to the retainer as at 88. The retainer 72 also has an outwardly facing annular seat 90 of a generally conical configuration that is essentially concentric with the axis 44 of the trap core 61.

Each trap assembly 46 further includes a reverse flow device 92 oriented substantially along the central axis 44 of the trap core 61. A cylindrical opening 94 is formed in each cover 28 along the respective axis 44, and a tubular guide member 96 is releasably secured to the cover through an intermediate electrically insulating washer pad 98. A cap 100 having an internal cylindrical chamber 102 and a suitable end fitting 104 is connected to the guide member 96 to receive a reciprocable piston element 106 therein. The piston element includes a piston head 108 and a hollow rod portion 110 having a cylindrical flow director 111 connected thereto that defines a generally converging flow choking orifice 112 serially connected to an internal chamber 114. The internal chamber 114 opens radially outwardly via a plurality of ports 116. A compression spring 118 is seated within the cap 100 so as to continually bias the piston head 108 and the piston element 106 outwardly or to the right when viewing FIG. 2.

During normal operation the piston element 106 is located to the right of the position illustrated in FIG. 2, and at that position a conical seat 120 formed on the inboard end of the guide member 96 is sealingly engaged by a corresponding conical seat 122 formed on the inboard end of the rod portion 110. A funnel-shaped shield or conical diffuser member 124 extends axially inwardly from the inboard end of the rod portion 110 and defines an inwardly facing annular seat 126. In the normal mode the conical seat 126 is axially displaced from the corresponding conical seat 90 on the retainer 72. A suitably perforated flow-distribution plate 128 is optionally rigidly connected to the inboard end of the flow director 111 so as to define a generally conical chamber 130 within the diffuser member 124 and immediately around the flow director to assure an even flow of an oxygen-containing gas to the ceramic disc 76 and to the trap core 61.

The regeneration apparatus 10 includes control means or a control device 132 for sequentially supplying such oxygen-containing gas into each one of the trap assemblies 46 and for initiating the controlled regeneration thereof. More particularly, the control device 132 shown in FIGS. 3, 4 and 5 serves to sequentially move each piston element 106 and diffuser member 124 axially to the inward position illustrated in FIG. 2 as will be later explained.

The control device 132 includes a timer motor 134 rotatably associated with a drive shaft 136 having a pair of oppositely disposed tangs 138 connected thereto. A first cam plate 140 is also secured to the drive shaft 136 which has a single cam lobe 142 thereon. A second cam plate 144 is connected to a distributor shaft 146 driven by the drive shaft, and this distributor shaft is rotatably mounted within a housing 148 in an axially aligned relationship with the drive shaft 136, but with about 90 degrees backlash or lost motion therebetween which is provided by a pair of internal arcuate slots 149 separated by a pair of stop elements 150. A detent assembly 151 includes a roller 152 mounted on a holder and guide rod 153 reciprocably received in a bore 154 in the housing 148. The roller is urged radially inwardly into positive engagement with the formed periphery of the second cam plate 144 by a compression spring 156 seated against a stop member 158. In the embodiment illustrated in FIG. 4 there are eight lobes 160 formed on the second cam plate 144, and these lobes are individually separated by a profiled surface 162 defined by a shallow angle ramp 164, a steep angle ramp 166, and an arcuate trough 168 therebetween.

A first source of electrical energy 170 is connected to the timer motor 134, and a grounding line 172 is also connected thereto through a regeneration switch 174 and a microswitch 176 arranged in parallel with each other. The microswitch 176 has a cam following roller 178 that engages the periphery of the first cam plate 140 for the automatic actuation thereof. A pressurized source 180 of an oxygen-containing gas such as ambient air is connected to the housing 148 by a tube 182 connected to an internal passage 184 within the housing 148. An annular groove 186 is formed about the distributor shaft 146 in open communication with the passage 184, and a t-shaped passage 188 in the shaft is in open communication therewith and with a radially outwardly extending distributing port 190.

Figure 3:
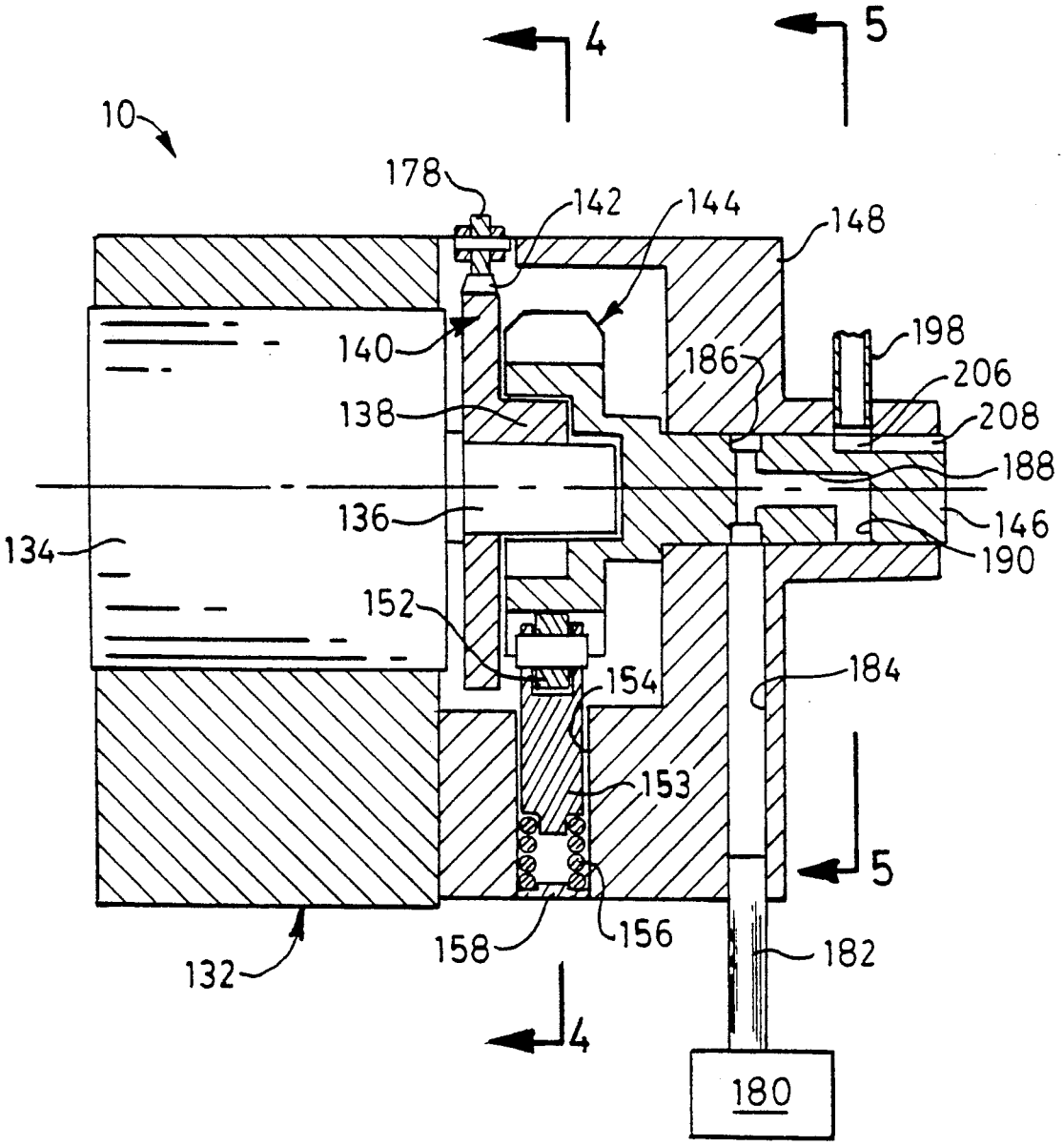
FIG. 3 is a diagrammatic sectionalized view of a control device for sequentially supplying an oxygen-containing gas into the trap assemblies shown in FIGS. 1 and 2.

Referring to FIG. 5, the single rotating distributing port 190 makes sequential alignment with a plurality of electrically nonconducting distribution tubes or hoses 192, 194, 196, 198, 200, 202 and 204 which individually extend radially outwardly from the housing 48 encircling the distributor shaft 146. A C-shaped groove 206 is formed about the distributor shaft 146 and is always connected to a longitudinally extending groove 208 open to the atmosphere as shown in FIG. 3. The electrically nonconducting hoses 192, 194, etc. extend to a junction block 210 as is illustrated in FIG. 1. That junction block clamps the hoses in an aligned relationship with a corresponding plurality of electrically conducting tubes 212, 214, 216, 218 and three others not shown. The latter tubes are individually connected to the respective fittings 104 on the outer ends of each trap assembly 46. Thus, the tubes 212, 214, 216, 218 etc. would not only sequentially carry air from the compressed air source 180, but also would serve as the electrical connection to the respective caps 100 of the trap assemblies. However, these tubes would be electrically insulated from the covers 28 and the housing 12 by the insulating pads 74 and 98 illustrated in FIG. 2. The junction block 210 would preferably be located away from the location shown in FIG. 1 to assure lower temperature operating conditions and an adequate service life for the hoses and tubes. Electrical conductors 220 and 222 capable of carrying the amperage necessary to energize the heating elements 82 shown in FIG. 2 would connect the junction block 210 to a second electrical power source 224 such as a conventional battery or an auxiliary alternator of greater power capacity than the first electrical power source 170.

Alternate Embodiment

Figure 8:
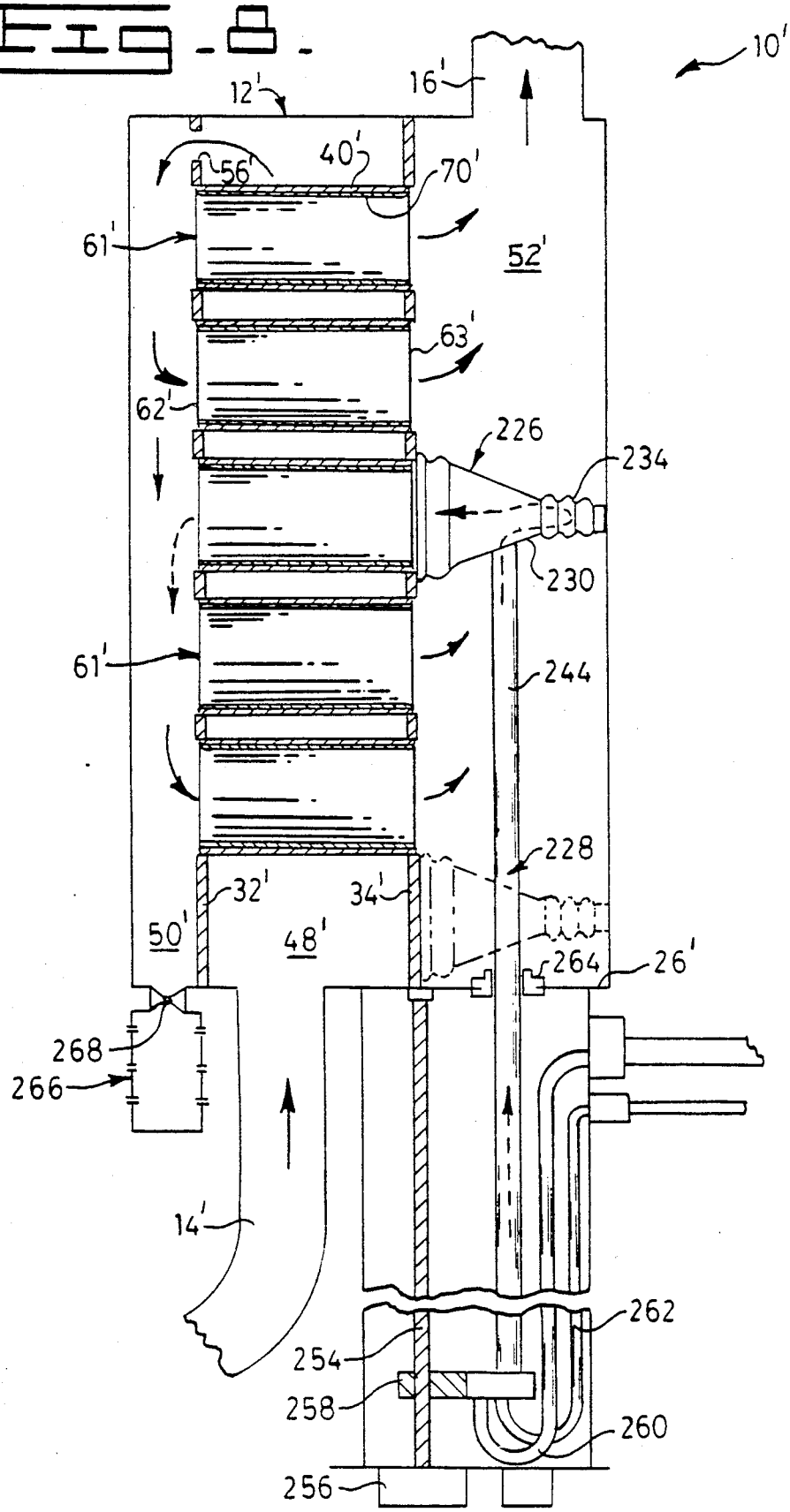
FIG. 8 is a diagrammatic vertical cross sectional view of an alternate embodiment particulate trap regeneration apparatus constructed in accordance with the present invention with portions broken away to foreshorten the illustration.
Figure 9:
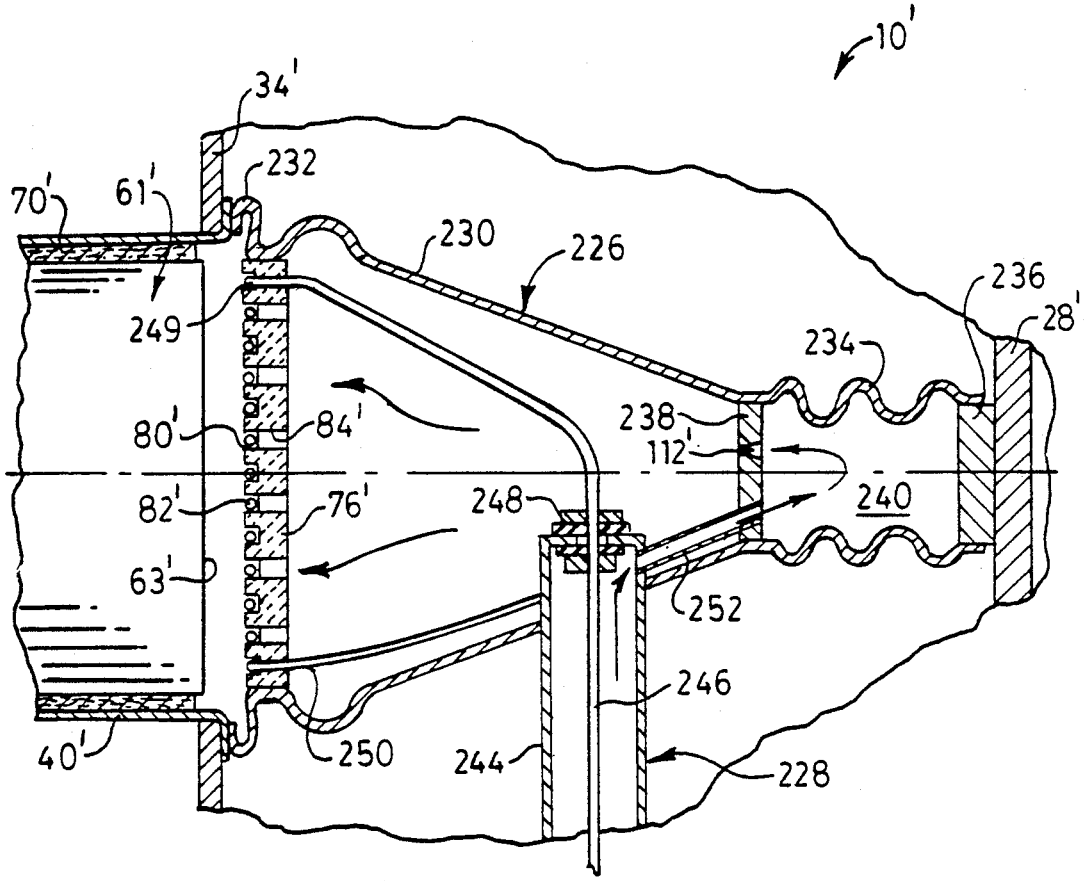
FIG. 9 is an enlarged diagrammatic sectionalized view of a portion of FIG. 8 showing details of the moveable conical heater unit illustrated therein.

A second embodiment particulate trap regeneration apparatus 10' is shown in FIGS. 8 and 9, wherein elements corresponding to those described in the first embodiment are identified by the same reference number with a prime indicator affixed thereto.

The cylindrically shaped, porous wall trap cores 61' are again located within bands or mats 70' contained within the sleeves 40' which extend between the partitions 32' and 34'. In this instance, however, the regeneration apparatus 10' includes a single reverse flow device or conical heater unit 226 and positioning means 228 for moving the heater unit into alignment with one of the trap cores for controlled regeneration thereof. The heater unit 226 includes a frusto conical housing 230 with a moderately flexible rolled-over lip section 232 at the inboard end, and an expandable corrugate bellows 234 and a load-distributing guide block 236 at the outboard end. A dividing wall 238 extends across the conical housing 230 to define an expansion chamber 240 within the bellows, and the dividing wall has a choking orifice 112' therein that controls the quantity of oxygen-containing gas such as air that is thereafter directed to the ceramic disc 76'. The ceramic disc is supported in this embodiment within the inboard end of the moveable conical housing 230, rather than nonmovably connected to the housing as in the first embodiment. The heating elements 82' are supported within the grooves 80' of the ceramic disc and are heated by passing an electrical current through their length.

The positioning means 228 includes a hollow support rod 244 rigidly connected to the heater unit 226 and an electrical conductor 246 within the support rod that is sealingly connected to the upper end of the support rod by an electrically insulated fastening device 248. Thus, the conductor 246 is electrically insulated from the conical housing 230 and is positively connected to the heating elements 82' as representatively indicated at 249, while the opposite ends of the heating elements are electrically grounded to the support rod and conical housing as indicated at 250. Air can be communicated from the hollow support rod 244 through a connecting tube 252 to the expansion chamber 240, and from there through the choking orifice 112' to the interior of the conical housing. Thereafter, the air passes through the holes or passages 84' and is heated by the heating elements, and relatively uniformly directed to the trap core 61' in a flow direction reverse to that of normal operation.

The positioning means 228 is effective to slide the heater unit 226 up and down, and in this embodiment includes a lead screw 254 controllably revolved by a drive motor 256. An internally threaded drive unit 258 is secured to the lower end of the support rod 244, as is a flexible hose 260 that is effective to supply pressurized air to the inside of the support rod at preselected times. Moreover, a flexible lead wire 262 is connected between a suitable power source and the electrical conductor 246 within the support rod. A sealing guide collar 264 fits closely around the support rod, but is free to move radially in the floor 26' to prevent binding.

FIG. 8 shows more clearly a perforated ash collecting pan 266 at the bottom of the exhaust housing or stack 12' immediately below the duct 50'. A small slot or passage 268 is disposed between the duct 50' and the collecting pan 266, which optionally could include a solenoid-operated valve, not shown.

Industrial Applicability

As can be appreciated by reference to FIG. 1, in normal engine operation the engine exhaust gases are directed upwardly from the inlet pipe 14 into the center duct 48 of the vertical stack 12. Thus, the exhaust gases are forced to travel upwardly around the sleeves 40, and through the opening 56 before passing downwardly and entering the individual trap cores 61 which are arranged in parallel with one another. The purpose of this is to cool the exhaust gases to improve the capture by the trap cores of the soluble fraction of the particulate mass and to improve the capture of the sulfates which are generated by the engine. This condensing of these materials and cooling of the exhaust gases prior to entry into the individual trap cores will also prevent any inadvertent ignition of the materials contained within them which might result in forward regeneration and possible damage to the trap cores. Also, in the preferred vertical stack the distribution of particulate matter is assisted by gravity, rather than possibly impeding it as will be subsequently explained. However, because the relatively higher exhaust flow will carry the soot and ash, the system will operate satisfactorily with any installed attitude.

In the normal mode no air is supplied to the individual trap assemblies 46 through the distribution tubes 212,214,216,218 etc., and thus there is no pressure in the chambers 102 representatively shown in FIG. 2. Piston element 106 is urged to the right from the position illustrated in FIG. 2 by the compression spring 118 such that conical diffuser member 124 is spaced 10 to 15 millimeters away from the retainer 72. Simultaneously, the annular sealing seats 90 and 126 are spaced axially apart and exhaust gases are permitted to pass from the first plurality of passages 64 to the second plurality of passages 66 through the porous walls 68 which filter out most of the soot as can be appreciated by reference to flow arrows A in FIG. 6. Because of the relatively high surface area of the preferred type of trap core 61 illustrated, low filter velocities and a relatively low initial pressure drop are experienced at high efficiency collection rates. From the passages 66 the filtered exhaust gases travel to the right through the holes 84 in the ceramic disc 76 and into the outlet duct 52 with a minimum pressure drop. Seats 120 and 122 are in contact with each other to prevent the entry of exhaust gases around the hollow rod portion 110 and within the guide member 96, and thereby prevent the formation of deposits that might impede the sliding action of the piston element 106.

Figure 6:
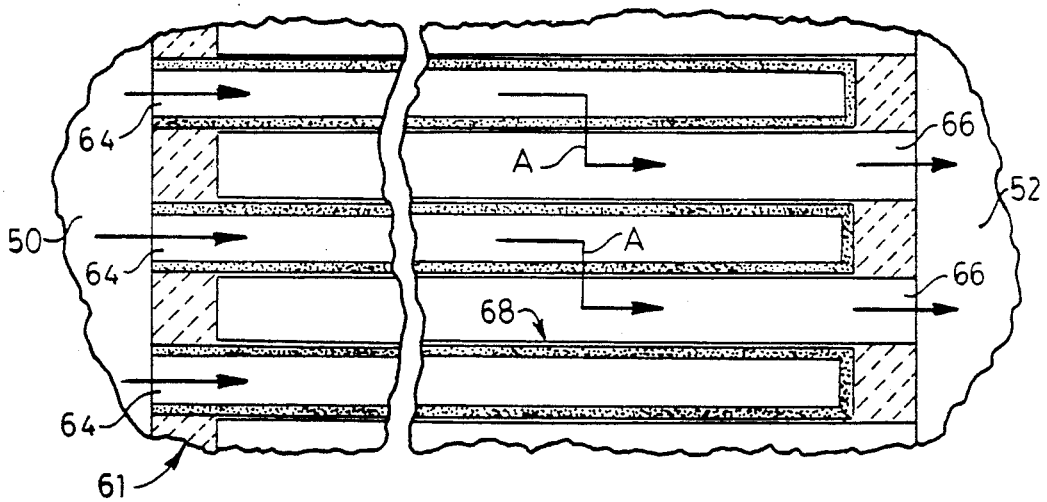
FIG. 6 is a fragmentary and enlarged portion of a preferred ceramic trap core having porous walls that is used with each of the trap assemblies used in FIG. 1, and showing a normal direction of exhaust gas flow from an engine.

The walls 68 of the trap core 61 gradually become loaded with particulate matter or soot on the inlet surfaces thereof as diagrammatically illustrated in FIG. 6. It is desirable to limit the pressure drop across the trap cores to a preselected value, for example a pressure drop equivalent to a water column of approximately 30 inches. Various means for sensing the time at which point the trap cores are loaded to this pressure limit could be utilized, such as trap differential pressure in relation to the exhaust flow, or a device to sense a preselected number of revolutions of the related engine.

When regeneration of the trap cores 61 is called for, the regenerator switch 174 shown in FIG. 4 is automatically closed for a brief period. This starts the rotation of the timer motor 134 and the drive shaft 136 in a clockwise direction as indicated by the arrow B. After a small amount of rotation the roller 178 of microswitch 176 will have dropped off the cam lobe 142 so as to close the microswitch. This will assure continued rotation of the timer motor 134 until completion of the regeneration cycle.

As the drive shaft 131 rotates, the tangs 138 force the second cam plate 144 to rotate along with the distributor shaft 146 integrally connected thereto. The detent roller 152 and holder and guide rod 153 are pushed downwardly when viewing FIG. 4 against the action of the spring 156. As the lobe 160 passes over the centerline of the detent roller the roller will be urged upwardly and down the shallow angle ramp 164. This action will push the second cam plate 144 further clockwise, using a portion of the backlash, until the detent roller rests in the trough 168. This action simultaneously causes the distribution port 190 shown in FIG. 5 to relatively swiftly align with the first distribution hose 192. Pressurized air from the source 180 shown in FIG. 3, at a pressure of from 40 to 100 psig for example, enters the passages 184, the annular groove 186, the passage 188, and out the distribution port 190 to the hose 192. Preferably, the hose 192 is in open communication with the tube 212 leading to the elevationally lowest trap assembly 46 in the exhaust stack 12.

Referring to FIG. 2, pressurized air would enter the chamber 102 of the lowest trap assembly 46 and force the piston element 106 to the left to the position illustrated, whereupon the conical diffuser member 124 abuts the retainer 72 and the conical seats 90 and 126 are forced together. As pressure builds up in the chamber 102, a relatively significant force is generated on the piston head 108 sufficient to offset the exhaust pressure acting on the conical diffuser member 124 and to provide a relatively tightly closed seal joint at the seats 90 and 126. The tight joint is enhanced by a slight distortion of the relatively thin metallic diffuser member. The same force assures a good electrical contact between the diffuser member 124 and the retainer 72. Electrical current will flow from the power source 224, junction block 210, and the tube 212 shown in FIG. 1, to the cap 100 shown in FIG. 2. Current will thereafter flow through the spring 118, the diffuser member 124, the retainer 72, to the heating element 82 at the positive connection 88, from which current will pass to the sleeve 40 via the ground connection 86. The heating element is preferably located close to, and parallel to, the face of the second end 63 of the trap core 61 since radiative heat transfer is thereby more effective and uniform and heat loss is minimized.

When pressure builds up in the chamber 102 air is forced to travel through hollow rod portion 110, through choking orifice 112, into chamber 114, and out the radially oriented ports 116 into the conical chamber 130. From the conical chamber pressurized air will travel through the variably spaced distribution holes in the perforated plate 128, the holes 84 in the ceramic disc 76 around the heating element 82, and will enter the passages 66 in the trap core 61. The use of the choking orifice 112 controls the air flow rate to a preselected substantially constant range around the heating element so that the amount of temperature increase of the air will be nearly constant and relatively insensitive to the back pressure on the engine, which will vary with the extent of accumulation of the soot on the trap core walls 68, and with other factors.

Although not specifically illustrated herein, it is also contemplated that the ceramic disc 76 and the heating element or elements 82 can alternatively be connected to the inboard end of the conical diffuser member 124 for reciprocal movement therewith toward and axially away from the second end 63 of the trap core. If this is done, the perforated plate 128 could be omitted.

Figure 7:
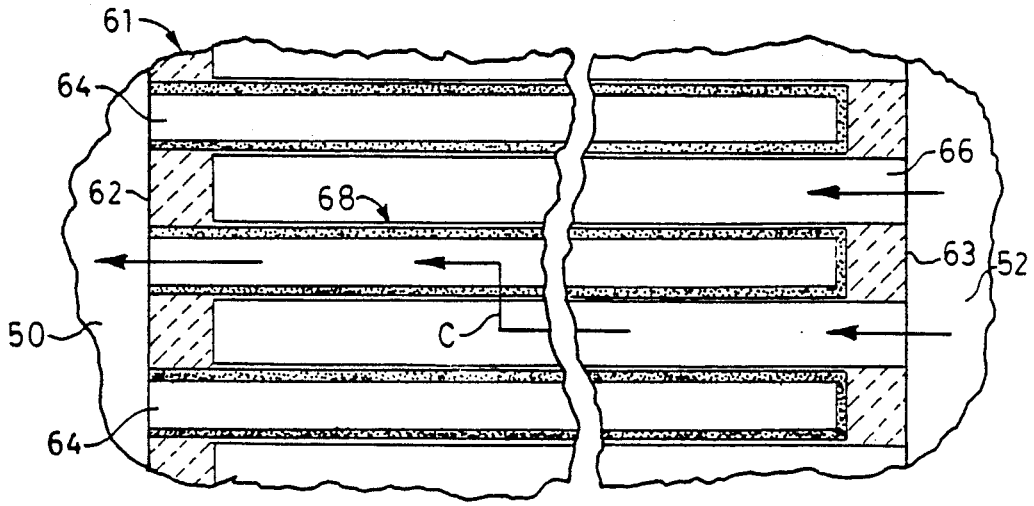
FIG. 7 is a view similar to FIG. 6 only showing a reverse flow of a heated oxygen-containing gas as supplied by the regeneration apparatus of the present invention.

Heated air enters the lowest trap core 61 by way of the second end 63 as shown in FIG. 7 and travels from the second plurality of passages 66 to the first plurality of passages 64 through the walls 68 as shown by flow arrow C. The porous material of the walls subsequently becomes heated until it reaches a temperature of approximately 500 degrees Celsius, or slightly above that value, at which time the soot will ignite and primarily burn progressively toward the first end 62 of the trap core. Because a sustained burning zone will propagate axially across the length of the trap core, it may be unnecessary to heat up its entire volume, and this serves to conserve electrical energy. The burned soot and/or other hot products of such combustion will pass out the passages 64 and into the inlet duct 50 with some portions thereof glowing or burning. Simultaneously, exhaust gases with particulate matter carried therein are being directed downwardly toward the remaining trap cores not being regenerated. So while a relatively small portion of the burning or burned soot might travel upwardly toward the trap core immediately above the lowest one, a substantially greater portion will settle in the ash trap 266 located at the bottom of the inlet duct 50. The ash trap 266 shown more clearly in FIG. 8 can optionally be filled with pellets of a material such as zinc ferrite to trap ash and any unburned soot and to neutralize sulfates. It can also optionally be provided with a separate high temperature heating element, not shown, to more completely burn any soot collected with the ash.

Although not shown, if a solenoid-operated valve is used in the location of the passage 268 above the perforated ash collecting pan 266 illustrated in FIG. 8, the valve could be timed to open the passage solely during the period in which the lowest trap core 61 is being regenerated. This action will assure that the ash and the soot, possibly still burning, will be directed to the collecting pan and will minimize the possibility o inadvertent ignition and burnout of the trap cores above the lowest one in the normal forward flow direction which could cause damage thereto. It can be appreciated that the burning soot and ash created when subsequent trap cores are regenerated will be conducted by the downwardly directed exhaust gas flow, which is much greater than that used for regeneration, into one or more already cleaned trap cores.

During the regeneration of the lowest trap core 61, the timer motor 134 and driving tangs 138 continue to rotate sufficiently to take up the backlash or lost motion within the slots 149, and when the tangs contact the stop elements 150 the second cam plate 144 rotates and urges the detent assembly 151 downwardly when viewing FIG. 4. As the detent roller 152 passes over the lobe 160 the second cam plate is rotated relatively quickly by the spring 156 ahead of the driving tangs. This results in the snap action rotation of the distributor shaft 146 so that the port 190 moves away from aligned communication with hose 192 and rapidly aligns with the next distribution hose 194 as can be visualized with reference to FIG. 5. This initiates the regeneration of the next trap core in the manner described above. As this occurs, C-shaped groove 206 registers with distribution hose 192 to release the air pressure therein more quickly than would occur by just continued flow through the chamber orifice 112 shown in FIG. 2. The piston chamber 102 of the lowest trap core is thus quickly depressurized, allowing spring 118 to urge the piston element 106 to the right to a retracted position. This separates the seats 90 and 126 and provides an annular escape opening so that the exhaust gases can again travel in the forward direction from the first end 62 to the second end 63 of the trap core 61, and simultaneously disconnects the electrical current source to the retainer 72 and heating element 82.

Timer motor 134 will continue to rotate at a constant speed until each trap core 61 has been burned out moving progressively upwardly when viewing FIG. 1. The speed of the timer motor and the design of the second cam plate 144 will assure that the proper amount of time is provided for the regeneration of each trap core. After the burn out of the uppermost trap core, the second cam plate 144 and the distributor shaft 164 are rotatably advanced to the position shown in FIG. 5, or to the position wherein the port 190 does not align with any of the distribution hoses. Simultaneously, the cam lobe 142 shown in FIG. 4 rotates sufficiently to lift the roller 178 and to open the microswitch 176. The timer motor 134 would then stop and wait until the regenerator switch 174 is closed to start a new regeneration cycle of the trap cores. During this waiting period, which might be several hours, all of the piston elements 106 are retracted and all of the trap cores 61 are functioning in the normal forward flow direction to remove deleterious matter from the exhaust gases.

The first embodiment regeneration apparatus 10 shown in FIGS. 1 and 2 is also very conveniently serviceable. Specifically, the distribution tube 218 can be uncoupled from the cap 100 after the electrical source 180 is disconnected therefrom. Then the fasteners 30 can be screwthreadably released from the walls 22 and 24, allowing the uppermost cover 28 to be pulled away from the remainder of the stack 12 along with the reverse flow device 92. The reverse flow device can then be easily serviced or repaired, or the ceramic disc 76 and heating element 82 be quickly visually checked. If desired, the retainer 72, the ceramic disc and the heating element can be removed through the cover opening so as to allow the trap core 61 to be serviced or replaced. The remaining trap assemblies can similarly be individually serviced.

The alternate embodiment trap regeneration apparatus 10' shown in FIGS. 8 and 9 shows the movable heater unit 226 coaxially aligned with one of the middle trap cores 61' for the regeneration thereof. At the proper time, pressurized air could be communicated from the vehicle's brake system, for example, to the support rod 244 and the connector tube 252 to the expansion chamber 240. As a result the bellows 234 expands to urge the guide block 236 to the right against the cover 28' and to urge the lip section 232 to the left against the partition 34' and to effect a relatively tight annular seal around the second end 63' of the trap core. From the chamber 240 pressurized air travels through the converging choking orifice 112' to the grooves 80' receiving the heating elements 82'. Electrical current initiated by a suitable switch, not shown, is directed through the conductor 246 to the heating elements so that the pressurized air is heated to a temperature above approximately 500 degrees Celsius before entering the second end 63' of the trap core.

The choking orifice 112' is generally a converging nozzle which has imposed on it at least about twice the absolute pressure at the entrance thereof than exists at the outlet. Mass flow through the orifice is dependent essentially only on upstream pressure and temperature, and the nozzle dimensions. A reasonably constant air flow is thus assured without the need for complicated controls, and the air can be heated to a predetermined value by a substantially constant amount of electrical power to the heating elements 82'.

Upon completion of the regeneration of the center trap core 61' essentially as heretofore described, the electrical current in the conductor 246 is turned off and then the pressurized air within the support rod 244 is opened to the atmosphere. The positioning means 228 is then activated to easily slide the heater unit 226 upwardly by the rotation of the lead screw 254 to a location of coaxial alignment with the next trap core 61'. Upon repressurizing the heater unit 226 the bellows 234 expands to create a pressure tight seal at lip section 232 around the normal outlet end 63' of the trap core without having close tolerances or complicated constructions to compensate for thermal expansion. The heating elements 82' remain hot when the electrical current is turned on again.

As is shown in phantom outline form in FIG. 8, The heater unit 226 resides in its most downward position during normal operation and does not register with any of the trap cores 61'. Exhaust gases travel upwardly in the center duct 48' and are cooled somewhat before travelling downwardly in the duct 50'. The exhaust gases are filtered by each of the trap cores before passing outwardly to the duct 52' and upwardly to exit via the outlet pipe 16'. When the individual trap cores are regenerated, burned or burning soot particles are forced outwardly to the left into the descending stream of dirty exhaust gases in duct 50', and the flow of exhaust gas assisted by the natural influence of gravity tends to urge them downwardly toward the perforated ash pa 266 so that a substantial portion thereof would not enter the remaining trap cores substantially as discussed before.

Thus, the conical diffuser member 124 or the conical housing 230 is controllably urged to the left when viewing FIGS. 2 and 9 by the piston element 106 or the resilient bellows 234 respectively. This provides, in effect, an annular valve about the normal outlet end of each of the cylindrical trap cores 61 that can be closed and sealed tight by the pressurized oxygen-containing gas for reverse flow regeneration. Such annular valve is opened for normal forward flow operation when the pressurized gas is decoupled therefrom. Although not shown, the operation of the regeneration apparatus 10 can be alternatively achieved by a timer, possibly solid state, which would sequentially direct an electrical signal to a plurality of solenoid-actuated valves to conduct the oxygen-containing gas to the selected reverse flow device 92.

Accordingly, the trap regeneration apparatus 10 of the present invention is expected to have a particle removal efficiency rate of 85% or more, with no bypassing of dirty or raw exhaust as is common with prior art devices. And, furthermore, the trap regeneration apparatus 10 accomplishes regeneration substantially independent of changing engine operating conditions such as continuously variable exhaust gas flow. Using a plurality of smaller trap cores is more reliable then using fewer large diameter trap cores, and the regeneration cycle can be achieved without sophisticated and costly control mechanisms. The ceramic material of the trap core walls 68 is maintained at a substantially lower temperature during regeneration because the controlled amount of heated air passing through the porous walls 68 from the clean side to the dirty side tends to keep the trap material temperature near that of the heated gas by what is known as transpiration cooling. For example, the wall temperature range is expected to be maintained at approximately 500 to 700 degrees Celsius, whereas in prior art devices the products of soot burn out are forced to travel through the walls so that temperatures are experienced in the 700 to 1000 degrees Celsius range, or even above. This lower temperature range will assure adequate trap core life regardless of the degree of soot loading or other variables. Moreover, the cooler temperature of the trap cores in normal operation will collect a greater percentage of soluble organic fraction sulfates.

Other aspects, objects and advantages of this invention can be obtained from a study of the drawings, the disclosure and the appended claims.

I claim:

1. A particulate trap regeneration apparatus of the type including a particulate trap core having a first end opening on a duct containing exhaust gases having particulate matter therein, and allowing the egress of filtered exhaust gases from a second end thereof to another duct, the improvement comprising:

regeneration means including an apparatus for directing a source of an oxygen-containing gas at a controlled rate independent of the operation of the engine toward the second end of the trap core, heating the oxygen-containing gas, forcing the heated oxygen-containing gas to travel through the trap core and egress at the first end thereof, and controllably burning the particulate matter accumulated within the trap core in a reverse flow manner.

2. The regeneration apparatus of claim 1 wherein the regeneration means includes a reverse flow device substantially coaxially aligned with the trap core and an electrical heating element adjacent the second end of the trap core.

3. The regeneration apparatus of claim 2 wherein the reverse flow device includes a choking orifice for controlling the rate of flow of the oxygen-containing gas to the trap core.

4. The regeneration apparatus of claim 3 wherein the regeneration means includes retainer means for holding the heater element, a control device for initiating regeneration through the reverse flow device, and the reverse flow device includes a member for directing electrical energy to the retainer means and heating the electrical heater element in response to actuation of the control device.

5. The regeneration apparatus of claim 4 wherein the retainer means includes a ceramic disc having a plurality of holes therethrough for the heated oxygen-containing gas to be directed upon the trap core.

6. The regeneration apparatus of claim 1 wherein the duct has a first partition having a first opening therethrough, the another duct has a second partition having a second opening therethrough, a sleeve spans the openings in the respective partitions, and the trap core is cylindrical and mounted within the sleeve.

7. The regeneration apparatus of claim 6 wherein the first partition has at least one further opening therethrough, the second partition has at least one further opening therethrough, at least one more sleeve spans the further openings, and at least one further trap core is mounted within the one more sleeve parallel to the trap core.

8. The regeneration apparatus of claim 7 wherein the regeneration means includes a similar reverse flow device substantially coaxially aligned with each trap core.

9. The regeneration apparatus of claim 8 wherein the regeneration means includes an electrical heating element for each trap core, and control means for causing electrical energy to be sequentially directed through the reverse flow device to the respective heating element.

10. The regeneration apparatus of claim 9 wherein each reverse flow device includes a reciprocable element, and the control means directs the oxygen-containing gas to the reciprocable element for moving it.

11. The regeneration apparatus of claim 9 wherein each reverse flow device includes a flow choking orifice for controlling the rate of flow of the oxygen-containing gas to the respective trap core.

12. The regeneration apparatus of claim 7 wherein the regeneration means includes in a substantially coaxially aligned relation with each trap core a ceramic disc, a heater element supported by the ceramic disc, a retainer for holding the ceramic disc, and reverse flow means for directing electrical energy to the respective heater element through the respective retainer.

13. The regeneration apparatus of claim 12 wherein the reverse flow means includes a reciprocable element having a conical member connected thereto sequentially engageable with the respective retainer.

14. The regeneration apparatus of claim 13 wherein the reciprocable element has a hollow rod portion and a piston head, and the reverse flow means includes guide means for supporting the reciprocable element and defining a pressurizable chamber in conjunction with the piston head.

15. The regeneration apparatus of claim 14 wherein the reverse flow means includes a distribution tube connected to each guide means, and control means for sequentially directing the oxygen-containing gas to the respective chamber for movement of the reciprocable element.

16. The regeneration apparatus of claim 7 wherein the regeneration means includes a heater unit and means for sequentially positioning the heater unit into a coaxially aligned relationship with each trap core.

17. The regeneration apparatus of claim 16 wherein the heater unit includes means for controlling the rate of delivery of and the heating of the oxygen-containing gas to the selected trap core.

18. The regeneration apparatus of claim 1 wherein the regeneration means includes an annular member, heater means supported within the annular member for heating the oxygen-containing gas, and positioning means for moving the annular member and positioning the heater means relatively closely adjacent the second end of the trap core in substantially coaxial alignment therewith.

19. The regeneration apparatus of claim 18 wherein the heater means includes an electrical heating element.

20. The regeneration apparatus of claim 1 wherein the regeneration means includes an annular member having a lip section, and positioning means for moving the lip section selectively toward the second end of the trap core forming a relatively tight seal therearound for reverse flow regeneration, and selectively away therefrom for normal forward flow filtering operation.

21. The regeneration apparatus of claim 20 wherein the positioning means includes a cap, a piston head within the cap, and an actuating chamber defined therebetween in selective communication with the source of the oxygen-containing gas.

22. The regeneration apparatus of claim 20 wherein the positioning means includes a bellows in selective communication with the source.

23. The regeneration apparatus of claim 1 wherein the trap core is of the ceramic, porous wall flow type, and the source of the oxygen-containing gas is pressurized air supplied independently of the exhaust gases.

24. A method of regenerating a particulate trap core including normally exposing a first end of a trap core of the porous wall flow type to a duct containing a source of exhaust gases from an engine having particulate matter therein, and allowing the egress of filtered exhaust gases to another duct at a second end of the trap core, comprising the steps of:

(a) directing a source of an oxygen-containing gas at a controlled rate toward the second end of the trap core through a reverse flow device substantially coaxially aligned therewith;

(b) heating the oxygen-containing gas;

(c) forcing the heated oxygen-containing gas to travel through the trap core and egress at the first end thereof; and (d) controllably burning the particulate matter contained in the trap core.

25. The method of claim 24 wherein step (a) includes restricting the flow of the oxygen-containing gas by a flow choking orifice in the reverse flow device.

26. The method of claim 24 including the step of (e) sequentially applying steps (a) through (c) to the trap core and to another trap core parallel thereto and similarly exposed to the respective ducts.

27. The method of claim 26 wherein step (e) includes the step of (f) sensing the number of revolutions of the related engine as an approximation of the particulate matter contained in the trap cores and sequentially initiating regeneration of the trap cores.

28. The method of claim 26 including providing another reverse flow device in substantially coaxially aligned relation with the another trap core, each of the reverse flow devices having a movable element defining a movable annular seat, and wherein step (a) includes moving the seat closably toward the respective trap core during regeneration thereof.

29. The method of claim 26 including the step of positioning a single heater unit into a coaxially aligned relation with the respective trap core for regeneration thereof.

30. The method of claim 24 wherein step (b) includes electrically heating the oxygen-containing gas by a heating element located adjacent the second end of the trap core.

31. A particulate trap regeneration apparatus of the type including an inlet duct exposed to a source of exhaust gases containing particulate matter, an outlet duct, and a particulate trap core having first and second ends connected to the inlet and outlet ducts respectively, the trap core including a plurality of porous walls defining a first plurality of axial passages in open communication with the inlet duct at the first end and a second plurality of axial passages in open communication with the outlet duct at the second end, the improvement comprising:

a source of pressurized air independent of the exhaust gases;

regeneration means for heating the source of air and forcing the heated air at a controlled rate into the second end of the trap core, the second plurality of passages, and through the porous walls into the first plurality of passages and the inlet duct in a reverse flow direction, and for burning a substantial portion of the particulate matter accumulated on the porous walls.

32. The regeneration apparatus of claim 31 including control means for maintaining an essentially constant pressure and temperature of the air directed into the second end of the trap core.

33. The regeneration apparatus of claim 32 wherein the regeneration means includes a fixed annular seat adjacent the second end of the trap core and a movable element having a movable annular seat, and control means for positioning the movable element to close the seats sealingly together during regeneration.

34. The regeneration apparatus of claim 33 wherein the regeneration means includes a heating element connected to and movable with the movable element.

35. The regeneration apparatus of claim 31 wherein the regeneration means includes a heater unit and positioning means for moving the heater unit into axial alignment with the trap core for regeneration and laterally away therefrom for normal operation.

36. The regeneration apparatus of claim 35 wherein the heater unit includes an electrical heating element and flow control means for assuring a relatively constant mass flow of air is directed upon the heating element from the source.

37. The regeneration apparatus of claim 36 wherein the flow control means includes a choking orifice.

38. A particulate trap regeneration apparatus comprising:

an exhaust housing having a first partition defining a first plurality of openings, a second partition defining a second plurality of openings, first means defining an inlet duct at one side of the first partition, and second means defining an outlet duct at the side of the second partition away from the first partition;

a sleeve extending between the partitions and sealed therewith at each pair of the respective first and second openings;

a particulate trap core contained within each sleeve and having a first end opening on the inlet duct and a second end opening on the outlet duct;

a reverse flow device substantially coaxially associated with each trap core; and means for operating a selected one of the reverse flow devices, directing a source of an oxygen-containing gas toward the second end of the selected trap core, heating the oxygen-containing gas, forcing the heated oxygen-containing gas through the selected trap core to egress at the first end thereof, and controllably burning the particulate matter accumulated within the selected trap core, while simultaneously allowing the remaining trap cores to filter the exhaust gases in a normal manner.

39. The regeneration apparatus of claim 38 including an electrical heating element adjacent the second end of each of the trap cores, the respective electrical heating element being actuated by the selected reverse flow device.

40. The regeneration apparatus of claim 38 including third means defining a center duct between the first and second partitions, the exhaust gases being directed serially through the center duct around the sleeves and into the inlet duct.

41. A particulate trap regeneration apparatus comprising:

an exhaust housing having a first partition defining a first plurality of openings, a second partition defining a second plurality of openings, first means defining an inlet duct outboard of the first partition, and second means defining an outlet duct outboard of the second partition;

a sleeve sealingly connected between the partitions between each pair of the respective first and second openings;

a particulate trap core contained within each sleeve and having a first end opening on the inlet duct and a second end opening on the outlet duct;

a conical housing;

a heating element connected to the conical housing; and means for positioning the conical housing and heating element into a substantially coaxial sealed engagement with a selected one of the trap cores, directing a source of an oxygen-containing gas toward the second end of the selected trap core, heating the oxygen-containing gas, forcing the heated oxygen-containing gas through the selected trap core to egress at the first end thereof, and controllably burning the particulate matter accumulated within the selected trap core, while simultaneously allowing the remaining trap cores to filter the exhaust gases in a normal manner.

42. A particulate trap regeneration apparatus comprising:

an exhaust housing having a first partition defining a first plurality of openings, a second partition defining a second plurality of openings, first means defining an inlet duct at one side of the first partition, and second means defining an outlet duct at the side of the second partition away from the first partition;

a sleeve extending between the partitions and sealed therewith at each pair of the respective first and second openings;

a particulate trap core contained within each sleeve and having a first end opening on the inlet duct and a second end opening on the outlet duct; and said exhaust housing also defining a centrally located duct between the partitions and so constructed and arranged that exhaust gases are forced to travel in the centrally located duct around the sleeves for partially cooling the exhaust gases prior to entry into the inlet duct and the trap cores.

* * * * *